US012534320B2

(12) United States Patent
Namiki

(10) Patent No.: US 12,534,320 B2
(45) Date of Patent: Jan. 27, 2026

(54) IMAGE READING DEVICE

(71) Applicant: SEIKO EPSON CORPORATION, Tokyo (JP)

(72) Inventor: Masaki Namiki, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 18/474,356

(22) Filed: Sep. 26, 2023

(65) Prior Publication Data

US 2024/0109738 A1 Apr. 4, 2024

(30) Foreign Application Priority Data

Sep. 29, 2022 (JP) ..... 2022-156822

(51) Int. Cl.
*B65H 5/02* (2006.01)
*B65H 3/06* (2006.01)

(52) U.S. Cl.
CPC ..... *B65H 5/025* (2013.01); *B65H 3/0638* (2013.01); *B65H 2403/51* (2013.01); *B65H 2403/54* (2013.01); *B65H 2403/81* (2013.01)

(58) Field of Classification Search
CPC ..... B65H 2403/51; B65H 2403/81; B65H 3/5284; B65H 2403/422; B65H 2403/72
See application file for complete search history.

(56) References Cited

U.S. PATENT DOCUMENTS 5,624,109 A * 4/1997 Tanaka ..... B65H 3/0684 271/118
9,085,427 B2 * 7/2015 Nogami ..... B65H 3/56
2020/0299091 A1 * 9/2020 Umi ..... B65H 9/20

FOREIGN PATENT DOCUMENTS

JP 2019-099298 A 6/2019

* cited by examiner

*Primary Examiner* — Howard J Sanders
(74) *Attorney, Agent, or Firm* — WORKMAN NYDEGGER

(57) ABSTRACT

An image reading device includes a first power transmission section configured to transmit a driving force to the input gear, wherein the first power transmission section is configured to transmit the driving force from a first drive source that drives the feed roller to the input gear and furthermore, the first power transmission section includes a one-way clutch that does not transmit the power of the first drive source to the input gear when the first drive source rotates in a first rotation direction, which is a rotation direction during medium feeding, and transmits the power of the first drive source to the input gear when the first drive source rotates in a second rotation direction, which is opposite to the first rotation direction.

6 Claims, 12 Drawing Sheets

IMAGE READING DEVICE

The present application is based on, and claims priority from JP Application Serial Number 2022-156822, filed Sep. 29, 2022, the disclosure of which is hereby incorporated by reference herein in its entirety.

BACKGROUND

1. Technical Field

The present disclosure relates to an image reading device for reading an image of a medium.

2. Related Art

In an image reading device, as shown in JP-A-2019-99298, a configuration has been proposed in which it is possible to switch between separate feed in which separation is performed and non-separation feed in which separation is not performed when medium is fed. The non-separation feed is effective for a form or the like in which a plurality of paper sheets are bundled together. In the image reading device described in JP-A-2019-99298, switching between separation feed and non-separation feed is performed by an electromagnetic clutch.

The configuration in which switching between separation feed and non-separation feed is performed by using a power source is desirable from the viewpoint of usability. However, when a dedicated power source for performing the switching between separation feed and non-separation feed is used, the cost of a control circuit, an encoder, and the like is required in addition to the cost of the power source, which leads to a significant increase in cost as a whole.

SUMMARY

In order to solve the above problem, an image reading device according to the present disclosure includes a feed roller for feeding a medium downstream in a transport direction; a separation roller configured to nip the medium between itself and the feed roller and to separate the medium, to enter a separating state in which the separation roller is driven in a rotation direction to return the medium upstream in the transport direction, and to enter a non-separating state in which driving force of rotation is not transmitted; a reading section that is positioned downstream of the feed roller and the separation roller in the transport direction and that is configured to read the medium; a switching section that includes an input gear which rotates by receiving power and that is configured to perform switching between the separating state and the non-separating state by rotation of the input gear in a certain rotation direction; a first power transmission section configured to transmit the driving force to the input gear; and a second power transmission section that is a power transmission section configured to transmit the driving force to the separation roller and in which a switch is performed, by the switching section, between a state in which the driving force is transmitted to the separation roller and a state in which the driving force is not transmitted to the separation roller, wherein the first power transmission section is configured to transmit driving force from a first drive source that drives the feed roller to the input gear and furthermore, the first power transmission section includes a one-way clutch that does not transmit power of the first drive source to the input gear when the first drive source rotates in a first rotation direction, which is a rotation direction during medium feeding, and transmits the power of the first drive source to the input gear when the first drive source rotates in a second rotation direction, which is opposite to the first rotation direction.

DESCRIPTION OF EMBODIMENTS

Figure 1:
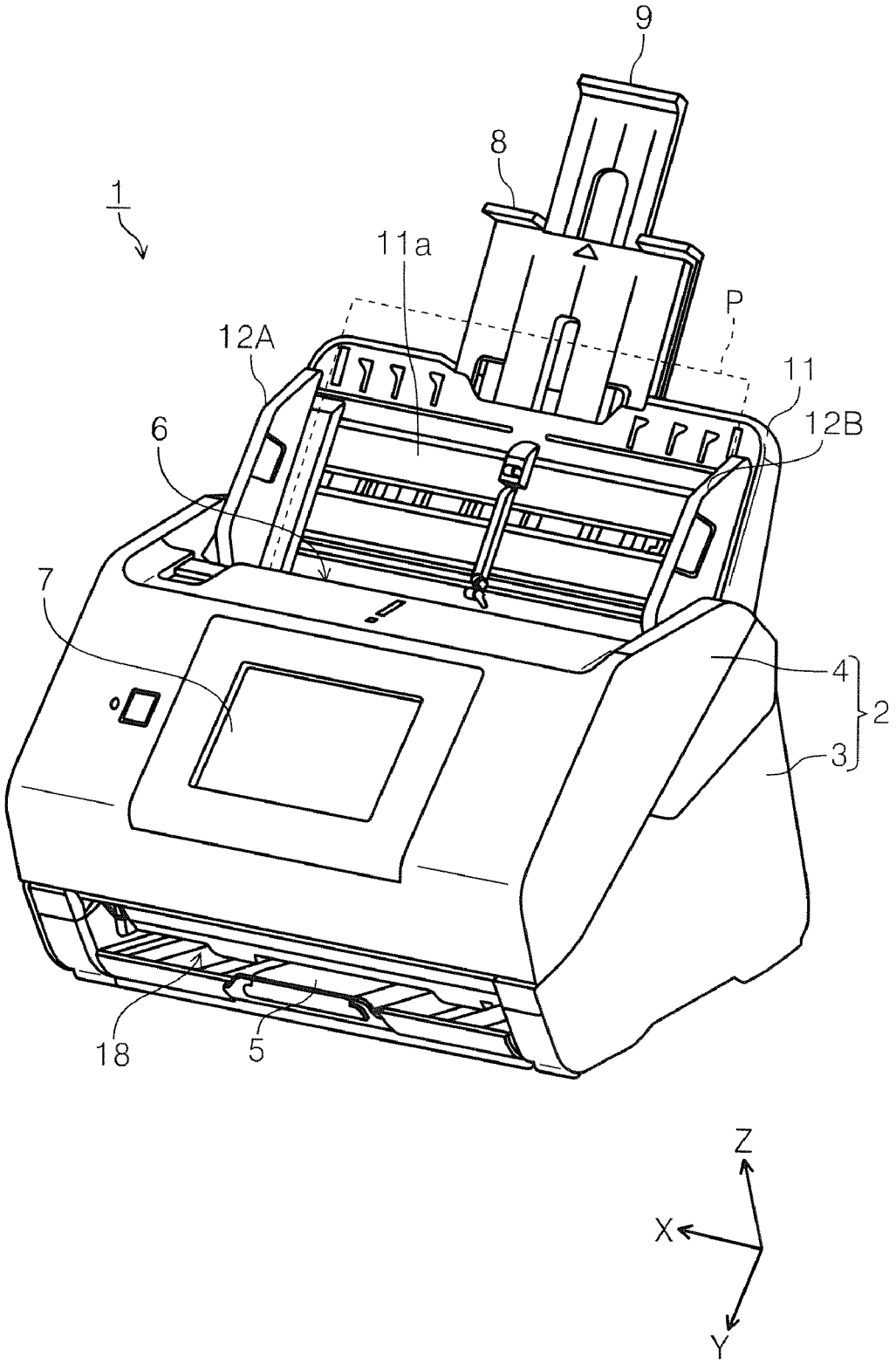
FIG. 1 is an external perspective view of a scanner.

The following is a schematic description of this disclosure.

An image reading device according to first aspect includes a feed roller for feeding a medium downstream in a transport direction; a separation roller configured to nip the medium between itself and the feed roller and to separate the medium, to enter a separating state in which the separation roller is driven in a rotation direction to return the medium upstream in the transport direction, and to enter a non-separating state in which driving force of rotation is not transmitted; a reading section that is positioned downstream of the feed roller and the separation roller in the transport direction and that is configured to read the medium; a switching section that includes an input gear which rotates by receiving power and that is configured to perform switching between the separating state and the non-separating state by rotation of the input gear in a certain rotation direction; a first power transmission section configured to transmit the driving force to the input gear; and a second power transmission section that is a power transmission section configured to transmit the driving force to the separation roller and in which a switch is performed, by the switching section, between a state in which the driving force is transmitted to the separation roller and a state in which the driving force is not transmitted to the separation roller, wherein the first power transmission section is configured to transmit driving force from a first drive source that drives the feed roller to the input gear and furthermore, the first power transmission section includes a one-way clutch that does not transmit power of the first drive source to the input gear when the first drive source rotates in a first rotation direction, which is a rotation direction during medium feeding, and transmits the power of the first drive source to the input gear when the first drive source rotates in a second rotation direction, which is opposite to the first rotation direction.

According to the present aspect, in the configuration in which the switching section switches the separation roller between the separating state and the non-separating state, the first power transmission section is configured to transmit the driving force to the switching section transmits the driving force of the rotation in the second rotation direction of the first drive source for driving the feed roller, that is, the rotation in the direction opposite to the rotation direction at the time of feeding the medium to the switching section, and thus, since the switching by the switching section is performed, a dedicated power source for the switching means is not required, and an increase in cost of the device can be suppressed.

A second aspect is an aspect according to the first aspect, wherein the second power transmission section includes a first gear and a second gear that is configured to advance and retract with respect to the first gear, that transmits the driving force to the separation roller by meshing with the first gear, and that does not transmit the driving force to the separation roller by separating from the first gear, the switching section includes a first swing member that is configured to support and swing the second gear and that causes the second gear to advance and retract with respect to the first gear by swinging, a pressing member configured to press the first swing member in a direction in which the second gear meshes with the first gear, a cam configured to rotate by rotation of the input gear, and a second swing member configured to swing the first swing member by rotating in accordance with rotation of the cam.

According to the present aspect, the switching section can be realized with a simple structure.

A third aspect is an aspect according to the second aspect, further includes a first unit constituting one side of a transport path for transport the medium and a second unit that is configured to open and close with respect to the first unit and that constitutes the other side of the transport path in a closed state, wherein the feed roller is provided in the first unit, the separation roller is provided in the second unit, the first gear is provided in the second unit, and the second gear is provided in the first unit.

According to the present aspect, the first gear is provided in the upper unit, and the second gear is provided in the lower unit. Here, since the upper unit is openable and closable with respect to the lower unit, the first gear advances and retracts with respect to the second gear according to the opening and closing of the upper unit. For this reason, the distance between the first gear and the second gear tends to vary, and there is a possibility that the first gear and the second gear may not mesh properly. However, since the second gear is pressed toward the first gear by the pressing member, variations in the distance between the first gear and the second gear can be suppressed, the first gear and the second gear can always mesh properly.

A fourth aspect is an aspect according to the third aspect, wherein a transport roller pair that is positioned between the feeding roller and the reading section in the transport direction and that is configured to transport the medium toward the reading section, wherein the second power transmission section is configured to transmit driving force from a second drive source that drives the transport roller pair to the separation roller.

According to the present aspect, since the second power transmission section is configured to transmit the driving force from the second drive source that drives the transport roller pair to the separation roller, a dedicated drive source for driving the separation roller is not necessary, and thus it is possible to suppress an increase in cost of the device.

The present aspect is not limited to the third aspect, and may be applied to any aspect of the first and second.

A fifth aspect is an aspect according to the third aspect, wherein the second power transmission section is configured to transmit the driving force from the first drive source to the separation roller.

According to the present aspect, since the second power transmission section is configured to transmit the driving force from the first drive source to the separation roller, a dedicated drive source for driving the separation roller is not necessary, and it is possible to suppress an increase in cost of the device.

The present aspect is not limited to the third aspect, and may be applied to any aspect of the first and second.

A sixth aspect is an aspect according to the first aspect, wherein the control member for controlling the first drive source when the separation roller is in the separating state when feeding of the medium is to be performed in the non-separating state, controls the first drive source to switch the separation roller to the non-separating state and when the separation roller is in the non-separating state when feeding of the medium is to be performed in the separating state, controls the first drive source to switch the separation roller to the separating state.

According to the present aspect, since the control member is configured to appropriately switch the state of the separation roller between a case where the medium is to be fed in the non-separating state and a case where the medium is to be fed in the separating state, that is, the state of the separation roller is appropriately switched without operation of a user, it is possible to appropriately feed the medium and to improve usability.

The present aspect is not limited to the first aspect, and may be applied to any one of the second to fifth aspects.

Hereinafter, the present disclosure will be specifically described.

Hereinafter, one embodiment of an image reading device will be described with reference to the drawings. In the present embodiment, as an example of the image reading device, a document scanner (hereinafter, simply referred to as a scanner 1) capable of reading at least one of a front surface and a rear surface of a document which is an example of a medium. Hereinafter, the document will be referred to as a document P with a reference symbol P.

In the X-Y-Z coordinate system shown in each drawing, an X-axis direction is a device width direction and a document width direction. The left is a +X direction and the right is a −X direction as viewed from the front of the device.

A Y-axis direction is a document transport direction. In the present embodiment, the Y-axis direction is a direction crossing a horizontal plane. Hereinafter, the +Y direction, which is the direction in which the document P is fed, may be referred to as "downstream", and the −Y direction, which is the opposite direction, may be referred to as "upstream".

A Z-axis direction is a direction intersecting with the Y-axis direction and is a direction substantially orthogonal to the surface of the document to be transported. A +Z direction is a direction including a vertically upward component, and a −Z direction is a direction including a vertically downward component.

In FIG. 1, the scanner 1 includes a device main body 2 in which a reading section 20 (see FIG. 2) that reads an image of the document P is provided.

Figure 2:
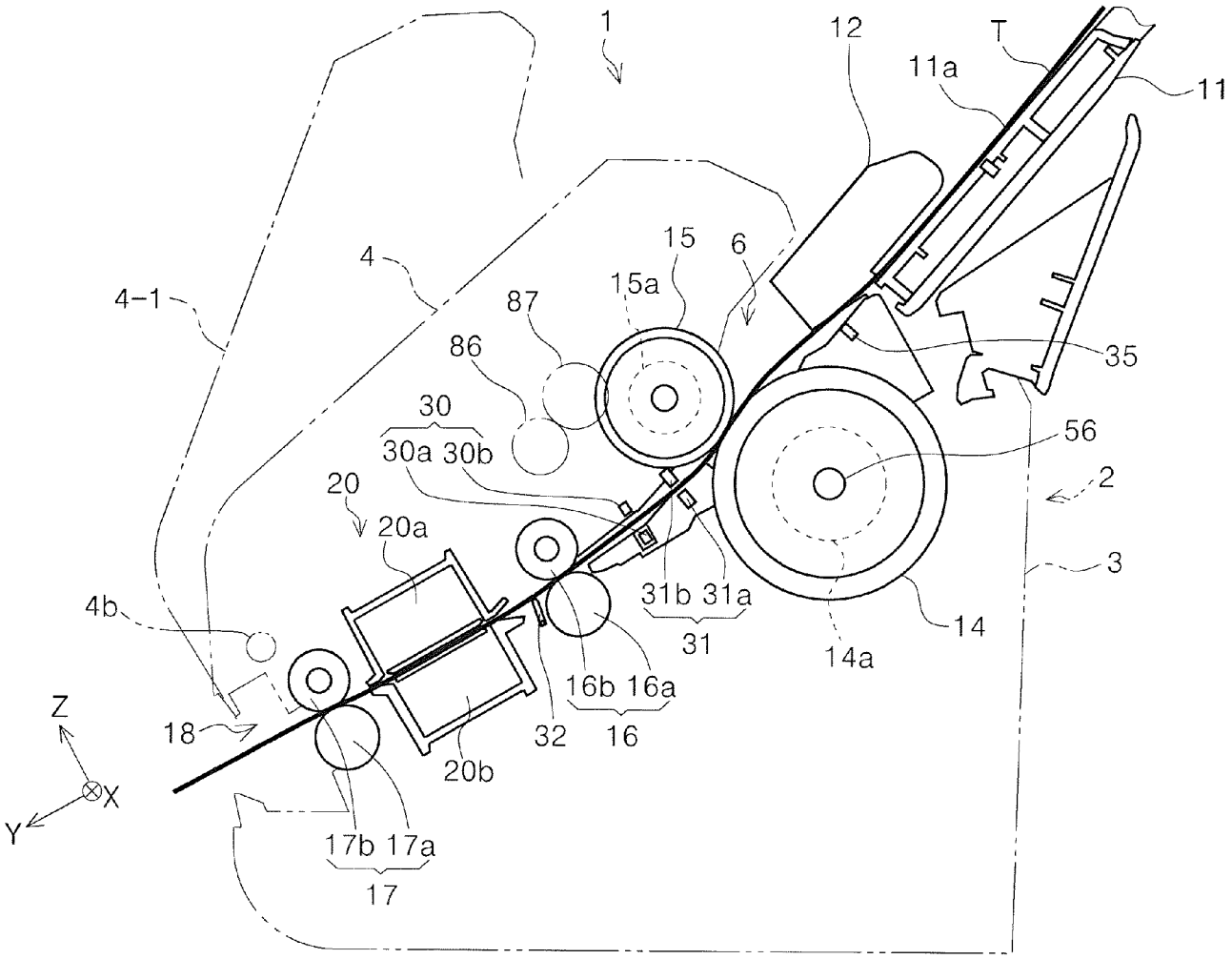
FIG. 2 is a diagram showing a document transport path in the scanner.

The device main body 2 includes a lower unit 3 and an upper unit 4. The upper unit 4 is provided so as to be openable and closable by rotating with respect to the lower unit 3, around a rotation shaft 4*b* (see FIG. 2), as a rotation fulcrum, which is downstream in the document transport direction. In FIG. 2, reference symbol 4-1 denotes the upper unit 4 in an open state. The lower unit 3 forms the lower side of the document transport path, and the upper unit 4 forms the upper side of the document transport path. Since the document transport path is formed between the lower unit 3 and the upper unit 4, the document transport path can be open when the upper unit 4 is rotated and open in the device front surface direction, whereby jam processing can be performed.

In FIG. 1, a document support section 11 that supports the document P to be fed is provided near the device rear surface of the device main body 2. The document support section 11 has a support surface 11*a*. The document support section 11 is provided with a pair of edge guides, specifically, a first edge guide 12A and a second edge guide 12B, for guiding width direction side edges of the document P. The first edge guide 12A and the second edge guide 12B are displaced in directions approaching and separating from each other by a rack and pinion mechanism (not shown).

The document support section 11 includes a first paper support 8 and a second paper support 9. The first paper support 8 and the second paper support 9 can be accommodated in the document support section 11 and, as shown in FIG. 1, can be pulled out from the document support section 11.

The device main body 2 includes, on the device front surface of the upper unit 4, an operation panel 7 which is a panel for performing operations of various reading settings and reading execution and on which a user interface (UI) indicating reading setting contents and the like is realized. In the present embodiment, the operation panel 7 is a so-called touch panel capable of performing both display and input, and serves as both an operation section for performing various operations and a display section for displaying various kinds of information.

A feed port 6 connected to an inside of the device main body 2 is provided in an upper section of the upper unit 4, and the document P supported by the document support section 11 is fed from the feed port 6 toward a reading section 20 provided inside the device main body 2.

A discharge tray 5 for receiving the document P discharged from the discharge port 18 is provided on the device front side of the lower unit 3.

Next, the document transport path in the scanner 1 will be described with reference to FIG. 2. FIG. 2 is a diagram schematically showing a document transport path in the scanner 1 according to the present disclosure. The scanner 1 can be regarded as a document transport device that transports the document P, from the viewpoint of omitting the function related to document reading, specifically, the reading section 20 (to be described later). Alternatively, even if the scanner 1 includes the reading section 20, the scanner 1 itself can be regarded as the document transport device from the viewpoint of document transport.

In FIG. 2, solid line indicated by a reference symbol T indicates the document transport path, in other words, a passing trajectory of the document P. The document transport path T is a space sandwiched between the lower unit 3 and the upper unit 4.

The document support section 11 is provided at the extreme upstream side of the document transport path T, and a feed roller 14, which feeds the document P supported on a support surface 11*a* of the document support section 11 toward the reading section 20, and a separation roller 15, which nips and separates the document P between itself and the feed roller 14, are provided on the downstream of the document support section 11.

The feed roller 14 contacts the lowermost one of the documents P supported on the support surface 11*a* of the document support section 11. Therefore, in a case where a plurality of documents P are set on the document support section 11 in the scanner 1, the documents P are sequentially fed downstream from the document P on the support surface 11*a* side.

Two feed rollers 14 are disposed so as to be symmetrical with respect to a center position in the document width direction.

Figure 3:
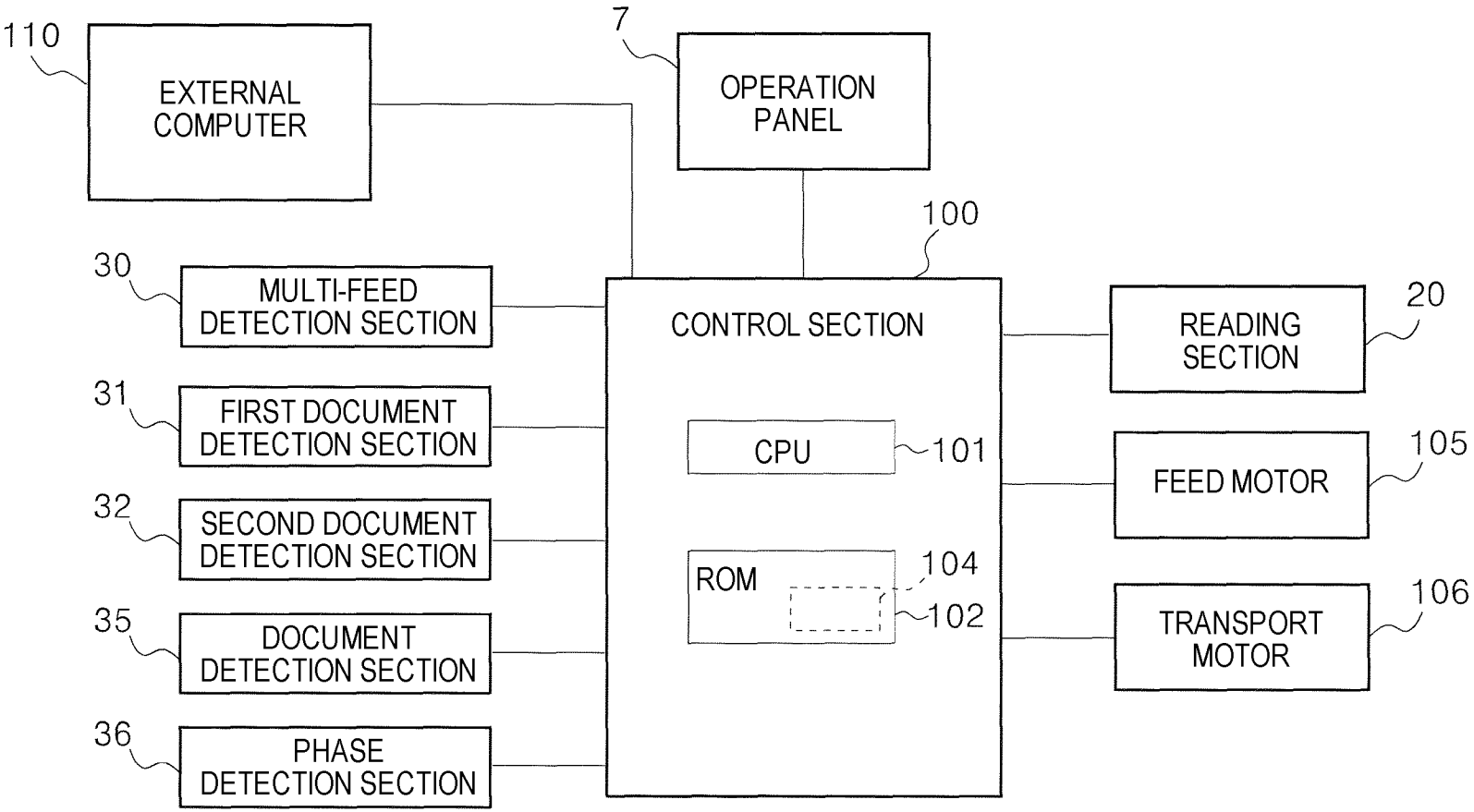
FIG. 3 is a block diagram showing a control system in the scanner.

The feed roller 14 is driven to rotate by a feed motor 105 (see FIG. 3). The feed roller 14 obtains rotational torque from the feed motor 105 and rotates in a counterclockwise direction in FIG. 2.

The driving force of the feed motor 105 is transmitted to the feed roller 14 via a one-way clutch 14*a*. The feed roller 14 obtains rotational torque from the feed motor 105 and rotates in the counterclockwise direction in FIG. 2, that is, in a forward rotation direction, thereby feeding the document P downstream.

Since the one-way clutch 14*a* is provided in the power transmission path between the feed roller 14 and the feed motor 105, the feed roller 14 does not rotate in the reverse direction even when the feed motor 105 rotates in the reverse direction. In addition, in a state where the feed motor 105 is stopped, the feed roller 14 contacts the document P which is transported, and can be driven to rotate in the forward rotation direction.

For example, when a leading edge of the document P is detected by a second document detection section 32 disposed downstream of a transport roller pair 16, a control section 100 (see FIG. 3, to be described later), stops driving the feed motor 105 and drives only a transport motor 106. As a result, the document P is transported by the transport roller pair 16, and the feed roller 14 is driven to rotate in the forward rotation direction while in contact with the transported document P.

Next, the separation roller 15 is capable of switching between a separating state, in which it separates documents P, and a non-separating state, in which it does not separate documents P. In the separating state, the separation roller 15 is driven in a rotation direction for returning the document P upstream and, in the non-separating state, rotation driving force is not transmitted.

The configuration for switching between the separating state and the non-separating state will be described in detail later.

In the separating state, rotational torque is transmitted from the transport motor 106 (see FIG. 3) to the separation roller 15 via a torque limiter 15*a*. During the feeding operation of the document P, the driving force for rotating the separation roller 15 in a reverse rotation direction (the counterclockwise direction in FIG. 2) is transmitted from the transport motor 106 to the separation roller 15.

In a case where no document P is interposed between the feed roller 14 and the separation roller 15, or in a case where only one document P is interposed between the feed roller 14 and the separation roller 15, the separation roller 15 is driven to rotate in the forward rotation direction regardless of the rotational torque received from the transport motor 106 due to slipping in the torque limiter 15*a*.

On the other hand, when a second or more documents P enter between the feed roller 14 and the separation roller 15 in addition to the document P to be fed, slipping occurs between the documents, so that the separation roller 15 rotates in reverse by the driving torque received from the transport motor 106. As a result, the multi-fed second or more documents P are returned upstream.

The transport roller pair 16, the reading section 20 that reads the image, and a discharge roller pair 17 are provided downstream of the feed roller 14. The transport roller pair 16 includes a transport drive roller 16*a* which is driven to rotate by the transport motor 106, and a transport driven roller 16*b* which is driven to rotate.

The document P nipped by the feed roller 14 and the separation roller 15 and fed to the downstream is nipped by the transport roller pair 16 and transported to the reading section 20 positioned on the downstream of the transport roller pair 16.

The reading section 20 includes an upper read sensor 20*a* provided on the upper unit 4 side and a lower read sensor 20*b* provided on the lower unit 3 side. In the present embodiment, as an example, the upper read sensor 20*a* and the lower read sensor 20*b* are configured as a contact image sensor module (CISM).

After the image on at least one of a front surface and a back surface of the document P is read by the reading section 20, the document P is nipped by the discharge roller pair 17 positioned downstream of the reading section 20 and is discharged from the discharge port 18, which is provided on the device front surface side of the lower unit 3.

The discharge roller pair 17 includes a discharge drive roller 17*a* which is driven to rotate by the transport motor 106, and a discharge driven roller 17*b* which is driven to rotate.

Next, the detecting members provided in the document transport path T will be described.

The document support section 11 is provided with a document detection section 35 for detecting whether or not the document P is present on the document support section 11. The document detection section 35 is composed of a light source and a sensor for receiving a reflected light component of light emitted from the light source, and the control section 100 (see FIG. 3) can detect the presence or absence of the document P on the document support section 11 based on the difference in the intensity of reflected light between the case where the document P is present on the document support section 11 and the case where the document P is not present on the document support section 11.

A first document detection section 31 is provided downstream of the feed roller 14. The first document detection section 31 is configured as an optical sensor, as an example, and includes a light emit section 31*a* and a light receive section 31*b* which are disposed to face each other with the document transport path T interposed therebetween, and the light receive section 31*b* transmits an electric signal indicating the intensity of detection light to the control section 100. When the transported document P blocks the detection light emitted from the light emit section 31*a*, the electric signal indicating the intensity of the detection light is changed, whereby the control section 100 can detect the passage of the leading edge or a trailing edge of the document P.

On the downstream of the first document detection section 31, a multi-feed detection section 30 for detecting the multi-feed of the document P is arranged. As shown in FIG. 2, the multi-feed detection section 30 includes an ultrasonic wave emit section 30*a* and an ultrasonic wave receive section 30*b*, which are disposed to face each other across the document transport path T and which receive ultrasonic waves, and the ultrasonic wave receive section 30*b* transmits an output value corresponding to the intensity of the detected ultrasonic waves to the control section 100. When double feed of the documents P occurs, an electric signal indicating the intensity of the ultrasonic wave changes, and thus the control section 100 can detect the double feed of the documents P.

The second document detection section 32 is provided downstream of the multi-feed detection section 30. The second document detection section 32 is configured as a contact sensor having a lever, and when the lever is rotated in accordance with the passage of the leading edge or the trailing edge of the document P, an electric signal sent from the second document detection section 32 to the control section 100 changes, whereby the control section 100 can detect the passage of the leading edge or the trailing edge of the document P.

The control section 100 can recognize the position of the document P in the document feeding path T by the first document detection section 31 and the second document detection section 32 described above.

Next, the control system in the scanner 1 will be described with reference to FIG. 3.

In FIG. 3, the control section 100 as the control member performs various kinds of control of the scanner 1, including feed, transport, and discharge control of the document P, and reading control. A signal from the operation panel 7 is input to the control section 100, and a signal for realizing the display of the operation panel 7, particularly the user interface (UI), is transmitted from the control section 100 to the operation panel 7.

The control section 100 controls the feed motor 105 and the transport motor 106. As described above, the feed motor 105 is a drive source of the feed roller 14 shown in FIG. 2, and is an example of a first drive source. The transport motor 106 is a drive source of the separation roller 15, the transport roller pair 16, and the discharge roller pair 17 shown in FIG. 2, and is an example of a second drive source. The feed motor 105 and the transport motor 106 are both DC motors in the present embodiment.

Read data from the reading section 20 is input to the control section 100, and a signal for controlling the reading section 20 is transmitted from the control section 100 to the reading section 20.

The control section 100 also receives signals from the document detection section 35, the multi-feed detection section 30, the first document detection section 31, the second document detection section 32, and other detecting members. The phase detection section 36 will be described later.

In addition, detection values of an encoder (not shown) which detects a rotation amount of the feed motor 105 and an encoder (not shown) which detects a rotation amount of the transport motor 106 are also input to the control section 100, and thus the control section 100 can detect a drive amount of a driving target of each motor.

The control section 100 includes a CPU 101 and a flash ROM 102. The CPU 101 performs various arithmetic processing according to the program 104 stored in the flash ROM 102, and controls the operation of the entire scanner 1. It is assumed that all of data and programs necessary for various controls are stored in the flash ROM 102, and values thereof are updated by the control section 100 as necessary. Various kinds of setting information input by the user via the operation panel 7 are also stored in the flash ROM 102.

The scanner 1 is configured to be connectable to an external computer 110, and information is input from the external computer 110 to the control section 100. The external computer 110 has a display section (not shown). On this display section, the user interface (UI) is realized by a control program stored in a storage member (not shown) included in the external computer 110.

Figure 4:
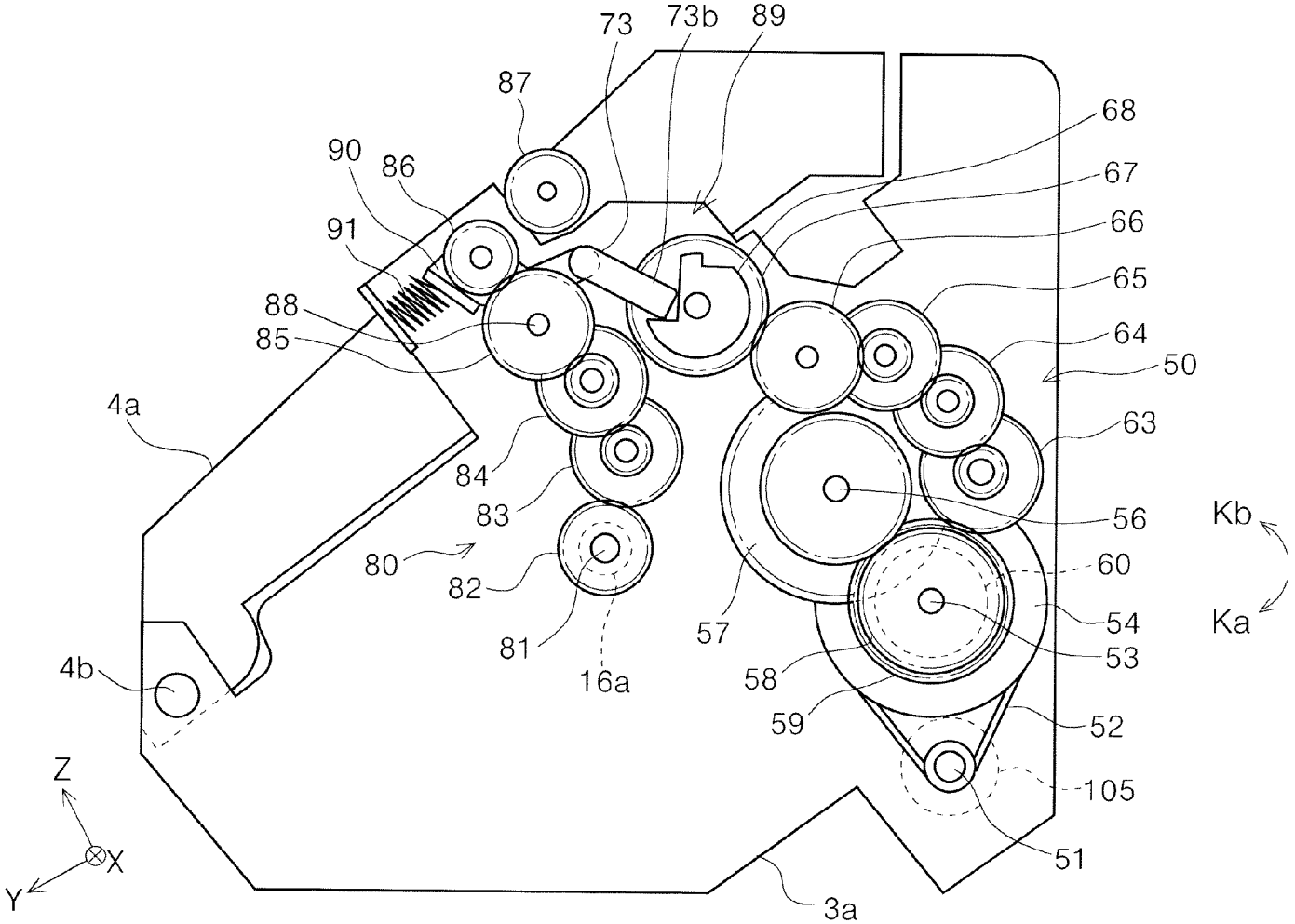
FIG. 4 is a front view of a switching section, a first power transmission section, and a second power transmission section in a state where the upper unit is closed.

Next, with reference to FIG. 4 and subsequent drawings, a description will be given of a configuration for switching the separation roller 15 between the separating state and the non-separating state. In FIG. 4 and subsequent drawings, a rotation direction of the member will be described using a direction Ka and a direction Kb.

In FIG. 4, a reference symbol 3*a* denotes a lower unit frame constituting the lower unit 3, and a reference symbol 4*a* denotes an upper unit frame constituting the upper unit 4.

A switching section 89 for switching the separation roller 15 between the separating state and the non-separating state is provided with an input gear 67, which is rotated by receiving power, and switching between the separating state and the non-separating state is performed by rotation of the input gear 67 in a certain rotation direction (the direction Ka). In the present embodiment, the switching section 89 performs switching between the separating state and the non-separating state of the separation roller 15 by rotation of the input gear 67 and a cam 68 (to be described later) in the direction Ka, but the switching section 89 may be configured to perform switching between the separating state and the non-separating state of the separation roller 15 by rotation in the direction Kb.

A first power transmission section 50 transmits the driving force to the input gear 67.

A second power transmission section 80 is a power transmission section that transmits the driving force to the separation roller 15, and is switched by the switching section 89 between a state in which the driving force is transmitted to the separation roller 15 and a state in which the driving force is not transmitted to the separation roller 15.

The switching section 89, the first power transmission section 50, and the second power transmission section 80 are provided at an end section of the device main body 2 in the −X direction.

First, the first power transmission section 50 will be described.

Figure 6:
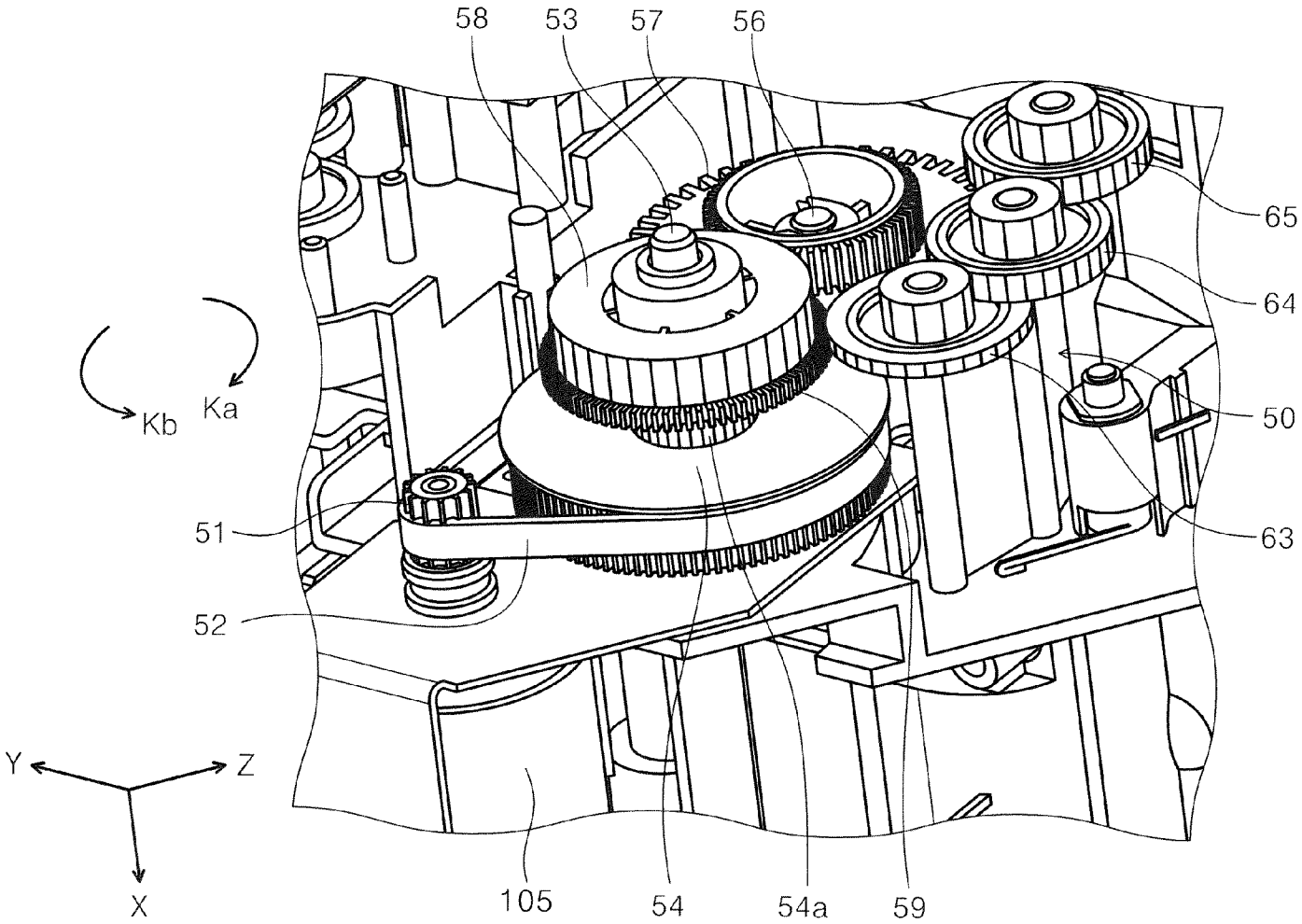
FIG. 6 is a perspective view showing a portion of the first power transmission section.

A drive pulley 51 is provided on a motor shaft of the feed motor 105, and a drive belt 52 is wound around the drive pulley 51 and a driven pulley 54. As shown in FIG. 6, a gear section 54*a* is integrally provided on the driven pulley 54, and a large-diameter gear of a two stage gear 57 meshes with the gear section 54*a*. In the present embodiment, the two stage gear is a gear in which the large-diameter gear and a small-diameter gear are integrally formed. In order to avoid complication of the drawings, the large-diameter gear and the small-diameter gear constituting the two stage gear are not denoted by reference symbols.

The driven pulley 54 rotates around a rotation shaft 53. The driven pulley 54 rotates relative to the rotation shaft 53.

Hereinafter, rotation of the feed motor 105 in a case where the drive pulley 51 provided on the motor shaft of the feed motor 105 rotates in the direction Ka in the drawing may be referred to as the forward rotation of the feed motor 105, and the rotation of the feed motor 105 in a case where the drive pulley 51 rotates in the direction Kb in the drawing may be referred to as the reverse rotation of the feed motor 105. When the feed motor 105 rotates forward, the feed roller 14 rotates forward to feed the document P downstream.

The two stage gear 57 is rotatable around a rotation shaft 56. The rotation shaft 56 is also a rotation shaft of the feed roller 14 and rotates integrally with the feed roller 14. The two stage gear 57 rotates relatively with respect to the rotation shaft 56. The one-way clutch 14*a* described above is provided between the two stage gear 57 and the rotation shaft 56. When the two stage gear 57 rotates in the direction Kb, the one-way clutch 14*a* described above transmits driving force to the rotation shaft 56, that is, to the feed roller 14, and when the two stage gear 57 rotates in the direction Ka, the one-way clutch 14*a* described above does not transmit driving force to the rotation shaft 56, that is, to the feed roller 14.

As shown in FIG. 6, the small-diameter gear of the two stage gear 57 meshes with a gear 58 to transmit the driving force to the gear 58. The gear 58 rotates around the rotation shaft 53. The gear 58 rotates relatively with respect to the rotation shaft 53. A gear 59 is rotatably provided on the rotation shaft 53. The gear 59 rotates relatively with respect to the rotation shaft 53. As shown in FIG. 4, a one-way clutch 60 is provided between the gear 58 and the gear 59, and when the feed motor 105 rotates forward, the gear 58 does not transmit power to the gear 59, and when the feed motor 105 rotates in reverse, the gear 58 transmits power to the gear 59. Thus, the gear 59 rotates only in the direction Kb.

A large-diameter gear of a two stage gear 63 meshes with the gear 59. A small-diameter gear of the two stage gear 63 meshes with a large-diameter gear of a two stage gear 64. A small-diameter gear of the two stage gear 64 meshes with a large-diameter gear of a two stage gear 65. A small-diameter gear of the two stage gear 65 meshes with a gear 66. The gear 66 is meshed with the input gear 67 of the switching section 89.

By rotation of the gear 59 in direction Kb, the input gear 67 rotates in the direction Ka.

By described above, the first power transmission section 50 includes the drive pulley 51, the drive belt 52, the driven pulley 54, the gear section 54*a*, the two stage gear 57, the gear 58, the one-way clutch 60, the gear 59, the two stage gears 63, 64, 65, and the gear 66.

The first power transmission section 50 is provided in the lower unit frame 3*a*.

Next, the second power transmission section 80 will be described.

In FIG. 4, a gear 82 is fixed to a rotation shaft 81 of the transport drive roller 16*a*. A large-diameter gear of a two stage gear 83 meshes with the gear 82, and a large-diameter gear of a two stage gear 84 meshes with a small-diameter gear of the two stage gear 83. A gear 85 meshes with a small-diameter gear of the two stage gear 84. A reference symbol 88 denotes a rotation shaft of the gear 85.

A gear 86 meshes with the gear 85. The gear 82, the two stage gears 83 and 84, the gear 85, and the gear 86 are provided on the lower unit frame 3*a*.

A gear 87 can mesh with the gear 86. The gear 87 is provided on the upper unit frame 4*a*. When the transport drive roller 16*a* rotates in the direction Kb and transports the document P downstream, the rotation shaft 81 rotates in the direction Kb, the gear 86 rotates in the direction Kb, and the gear 87, which meshes with the gear 86, rotates in the direction Ka. The gear 87 meshes with a gear (not shown) provided on a rotation shaft of the separation roller 15 and, when the gear 87 rotates in the direction Ka, rotational torque in a direction in which the medium P is returned to the upstream side is transmitted to the separation roller 15.

The gear 87 is an example of a first gear. The gear 86 is a gear configured to advance and retract with respect to the gear 87, and is an example of a second gear that transmits the driving force to the separation roller 15 by meshing with the gear 87 and does not transmit the driving force to the separation roller 15 by separating from the gear 87.

As described above, the second power transmission section 80 includes the gear 82, the two stage gears 83 and 84, and the gears 85, 86, and 87.

Next, the switching section 89 will be described.

The switching section 89 includes the first swing member 90, which supports the gear 86 and which is configured to swing and, by swinging, causes the gear 86 to advance and retract with respect to the gear 87, and a compression spring 91, which is an example of a pressing member for pressing the first swing member 90 in a direction in which the gear 86 meshes with the gear 87. The switching section 89 includes the cam 68, which is rotated by the rotation of the input gear 67, and a second swing member 73, which is a swingable member, can be engaged with the cam 68 and the first swing member 90, and swings the first swing member 90 by being rotated by rotation of the cam 68.

Figure 7:
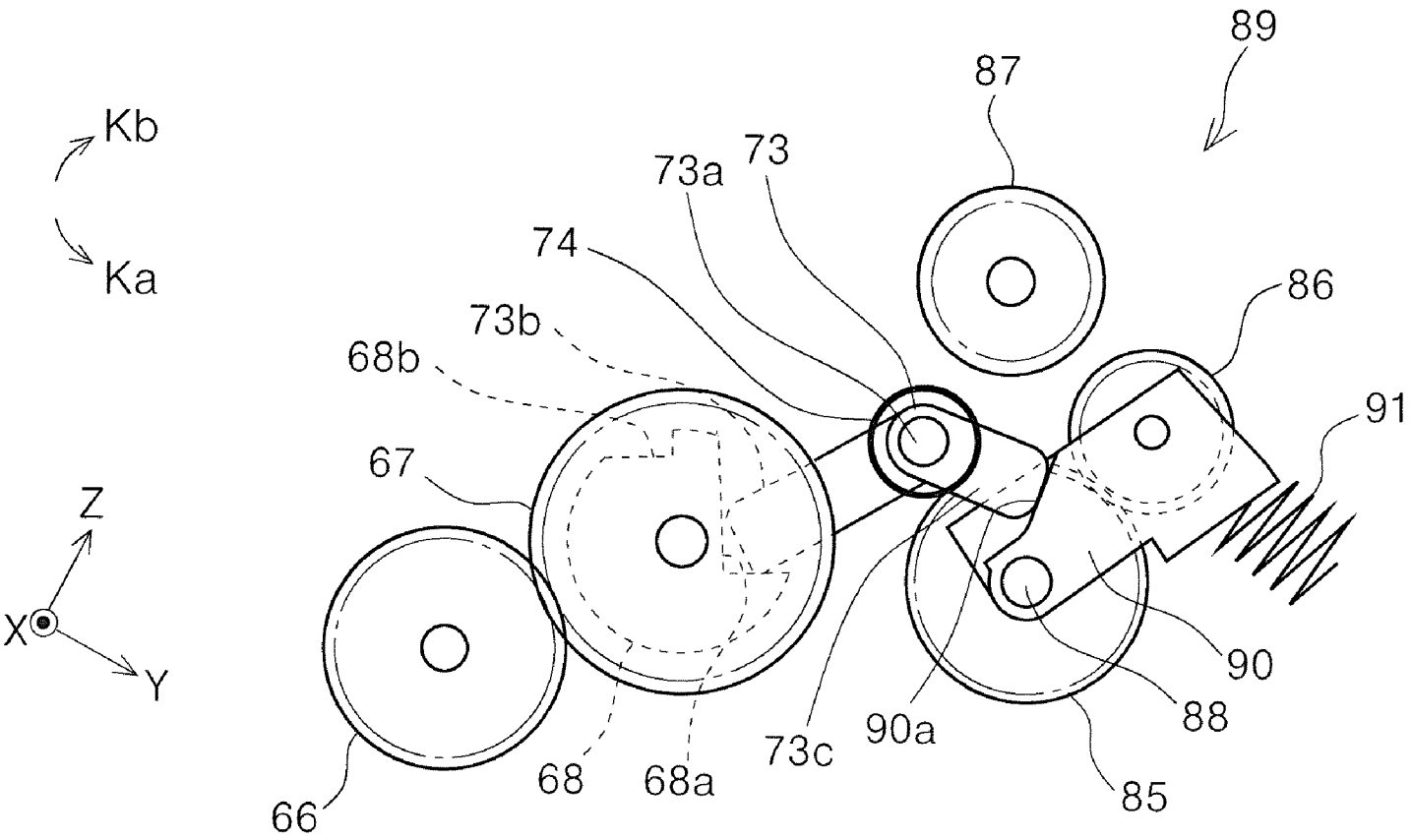
FIG. 7 is a view of the switching section as viewed from the +X direction, which is opposite from that of FIGS. 4 and 5, and is a diagram illustrating a case where a separation roller is in a non-separating state.
Figure 8:
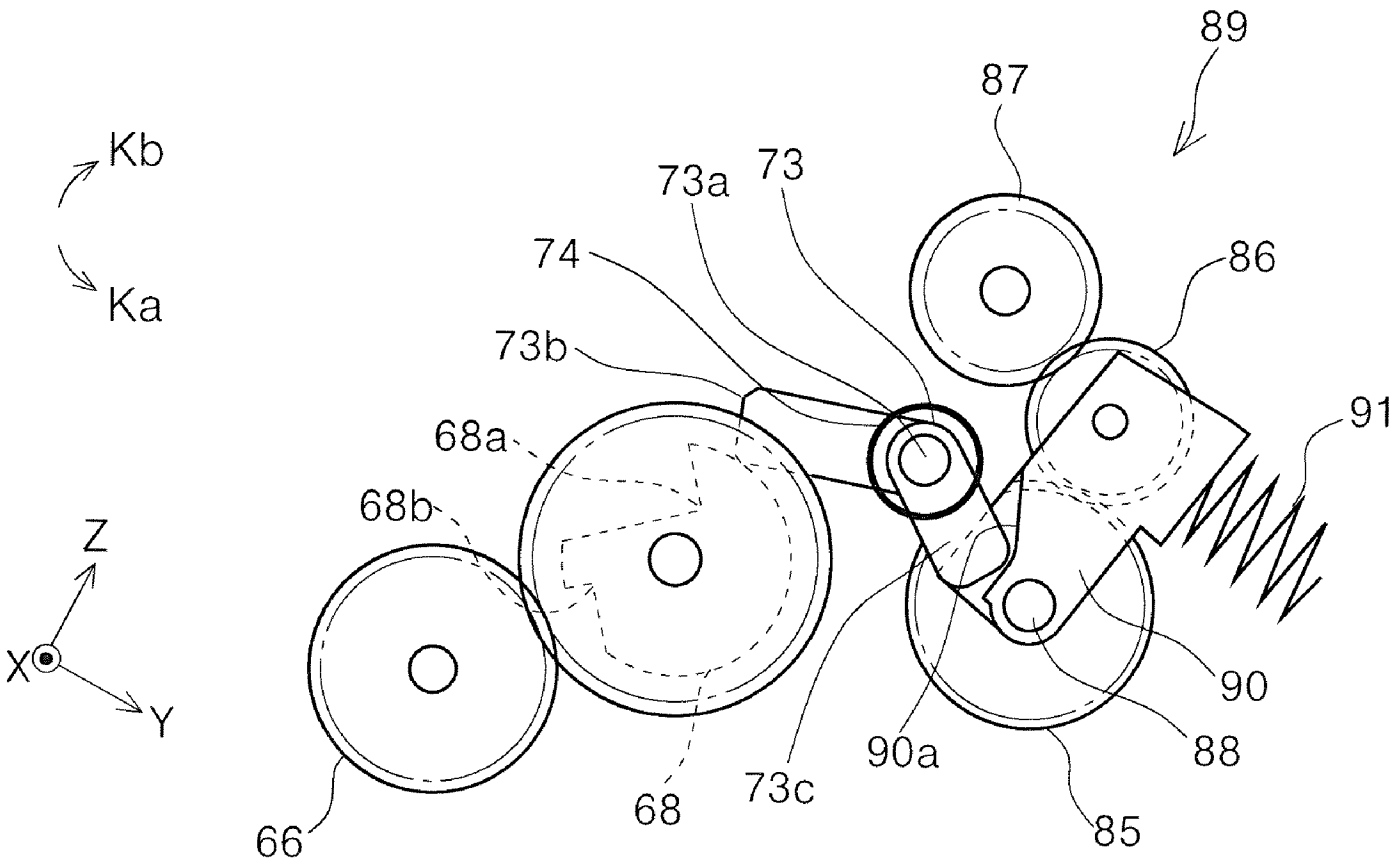
FIG. 8 is a view of the switching section as viewed from the +X direction, which is opposite from that of FIGS. 4 and 5, and is a diagram illustrating a case where the separation roller is in a separating state.

Further description will be given below with reference to FIGS. 7 and 8. FIG. 7 shows a state of the switching section 89 when the gear 86 is separated from the gear 87 and the separation roller 15 is in the non-separating state. FIG. 8 shows a state of the switching section 89 when the gear 86 is meshed with the gear 87 and the separation roller 15 is in the separating state.

The cam 68 is integrally formed with the input gear 67 and rotates in the direction Ka. A first recess section 68*a* and a second recess section 68*b* are formed in the cam 68.

The second swing member 73 is swingable around a swing shaft 73*a*, and has a cam engagement section 73*b* extending from the swing shaft 73*a* toward the cam 68, and a pressing section 73*c* extending from the swing shaft 73*a* toward the first swing member 90. The second swing member 73 is pressed in the direction Ka by a torsion spring 74 which is an example of a pressing member.

The first swing member 90 is swingable around the rotation shaft 88. The first swing member 90 supports the gear 86 so as to maintain a state in which the gear 86 meshes with the gear 85. By the swinging of the first swing member 90, the gear 86 advances and retracts with respect to the gear 87 while performing a planetary motion around the gear 85.

A pressed section 90*a* is formed in the first swing member 90, and the pressed section 90*a* is pressed by the pressing section 73*c*.

The cam engagement section 73*b* of the second swing member 73 is pressed against the cam 68 by the pressing force of the torsion spring 74. As shown in FIG. 7, in a state where the cam engagement section 73*b* enters the first recess section 68*a* of the cam 68, the pressing section 73*c* of the second swing member 73 presses the pressed section 90*a* of the first swing member 90, and the rotation of the first swing member 90 in the direction Ka is restricted. As a result, the gear 86 is separated from the gear 87, and the separation roller 15 maintains the non-separating state.

As shown in FIG. 8, in a state where the cam engagement section 73*b* is pulled out from the first recess section 68*a* of the cam 68 and the cam engagement section 73*b* is pressed against an arcuate section of the cam 68, the pressing section 73*c* of the second swing member 73 separates from the pressed section 90*a* of the first swing member 90, and the first swing member 90 is allowed to rotate in the direction Ka. As a result, the gear 86 is pressed against the gear 87 by a spring force of the compression spring 91, that is, the gear 86 and the gear 87 become meshed with each other, and the separation roller 15 enters the separating state.

Figure 9A:
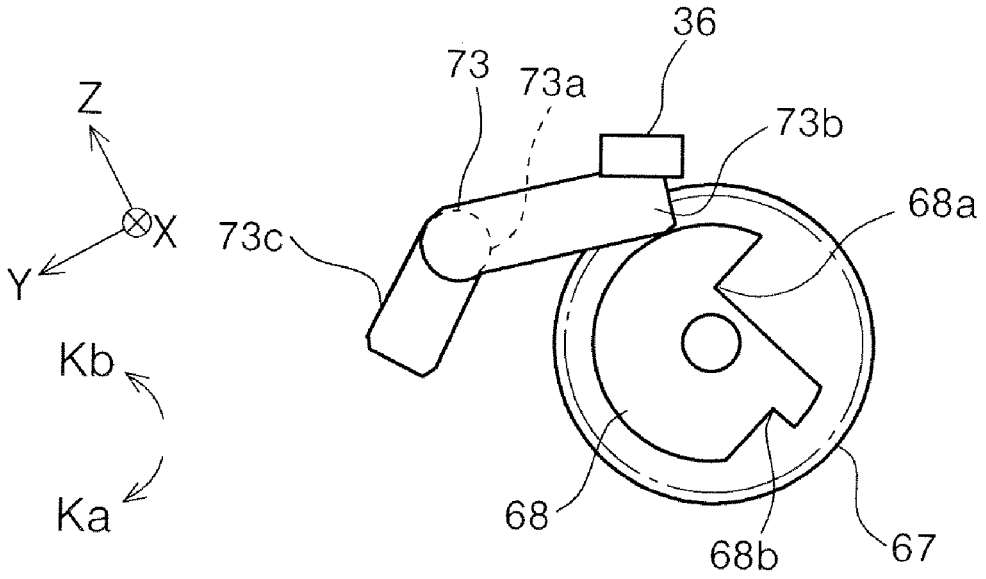
FIGS. 9A and 9B are diagrams showing a relationship between a phase detection section and a second swing member.
Figure 9B:
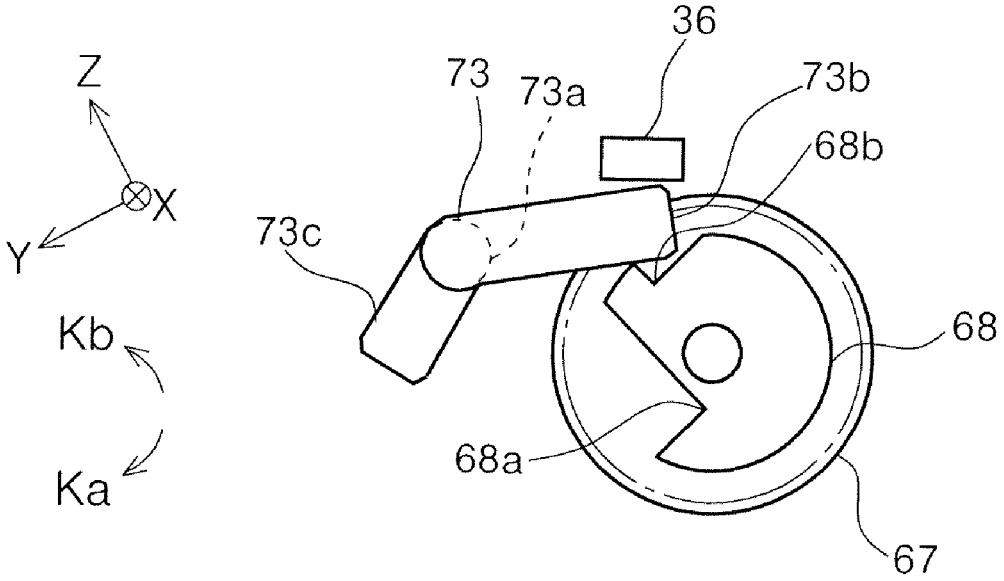

The second recess section 68*b* formed in the cam 68 functions as follows. As shown in FIGS. 9A and 9B, the phase detection section 36 is provided at a position facing the cam engagement section 73*b* of the second swing member 73. In a state in which the cam engagement section 73*b* of the second swing member 73 is in contact with the arcuate section of the cam 68 of the cam 68, the cam engagement section 73*b* of the second swing member 73 is engaged with the phase detection section 36 as shown in FIG. 9A, whereby the control section 100 (see FIG. 3) can detect that the cam engagement section 73*b* of the second swing member 73 is in contact with the arcuate section of the cam 68.

When the cam engagement section 73*b* of the second swing member 73 enters the second recess section 68*b* as shown in FIG. 9B, the cam engagement section 73*b* is disengaged from the phase detection section 36 for a brief time. Therefore, the second recess section 68*b* is formed smaller than the first recess section 68*a*. The control section 100 (see FIG. 3) can detect the phases of the cam 68 by detecting the brief time during which the cam engagement section 73*b* is disengaged from the phase detection section 36 in this manner.

After detecting the phase of the cam 68, the control section 100 can detect whether the separation roller 15 is in the separating state or the non-separating state based on the detection information of the phase detection section 36. Specifically, when the phase detection section 36 detects the cam engagement section 73*b*, it can be determined that the separation roller 15 is in the separating state, and when the phase detection section 36 does not detect the cam engagement section 73*b* and it can be determined that the cam engagement section 73*b* is in the first recess section 68*a*, it can be determined that the separation roller 15 is in the non-separating state.

Figure 5:
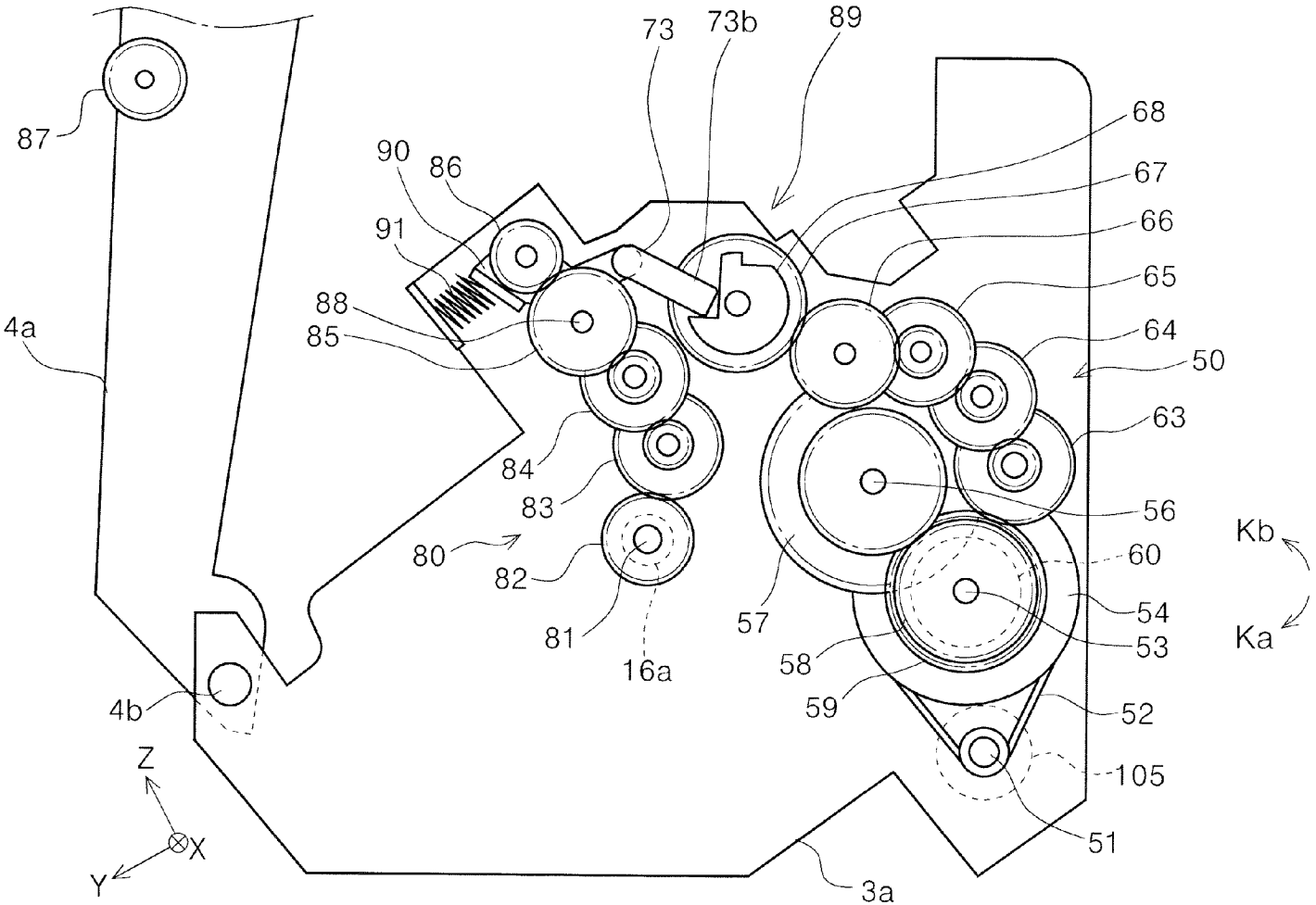
FIG. 5 is a front view of the switching section, the first power transmission section, and the second power transmission section in a state in which the upper unit is open.

Next, as described above, since the gear 86 is provided on the lower unit frame 3*a* and the gear 87 is provided on the upper unit frame 4*a*, when the upper unit 4 is open, as shown in FIG. 5, the gear 87 is separated from the gear 86 regardless of the state of the switching section 89.

As described above, the first power transmission section 50 transmits the driving force from the feed motor 105, which is an example of the first drive source, to the input gear 67. Further, the first power transmission section 50 has the one-way clutch 60. The one-way clutch 60 does not transmit the power of the feed motor 105 to the input gear 67 when the feed motor 105 rotates in the first rotation direction (direction Ka), that is, the forward rotation, and transmits the power of the feed motor 105 to the input gear 67 when the feed motor 105 rotates in the second rotation direction (direction Kb), that is, the reverse rotation.

In the configuration in which the separation roller 15 is switched between the separating state and the non-separating state by the switching section 89 as described above, the first power transmission section 50, which transmits the driving force to the switching section 89, transmits the reverse rotation driving force of the feed motor 105 that drives the feed roller 14 to the switching section 89, whereby the switching is performed by the switching section 89, so that a dedicated power source for the switching section 89 becomes unnecessary, and an increase in the cost of the apparatus can be suppressed.

Further, according to the configuration of the switching section 89 as in the present embodiment, the switching section 89 can be realized with a simple configuration.

In the present embodiment, the gear 87 is provided in the upper unit 4, and the gear 86 is provided in the lower unit 3. Since the upper unit 4 can be open and close with respect to the lower unit 3, the gear 87 advances and retracts with respect to the gear 86 in accordance with the opening and closing of the upper unit 4. Therefore, the interval between the gear 87 and the gear 86 is likely to vary, and there is a possibility that the gear 87 and the gear 86 cannot mesh correctly. However, since the gear 86 is pressed toward the gear 87 by the compression spring 91, which is a pressing member, it is possible to suppress variations in the interval between the gear 87 and the gear 86, and the gear 87 and the gear 86 can always mesh correctly.

Further, in the present embodiment, since the second power transmission section 80 is configured to transmit the driving force from the transport motor 106, which is the second drive source for driving the transport roller pair 16, to the separation roller 15, a dedicated drive source for driving the separation roller 15 is not required, and the cost increase of the device can be suppressed.

However, for example, in FIG. 4, the two stage gear 83 constituting the second power transmission section 80 may be meshed with the two stage gear 57 so that the second power transmission section 80 transmits the driving force from the feed motor 105 to the separation roller 15. Even in this case, a dedicated drive source for driving the separation roller 15 is not required, and an increase in the cost of the device can be suppressed.

Further, in the present embodiment, the gear 86 advances and retreats with respect to the gear 87, and the switching section 89 is provided in the lower unit 3, but the gear 87 may advance and retreat with respect to the gear 86, and the switching section 89 may be provided in the upper unit 4. In this case, the switching section 89 may be driven by a motor provided in the upper unit 4. The motor provided in the upper unit 4 is, as an example, a motor for driving the separation roller 15.

Figure 10:
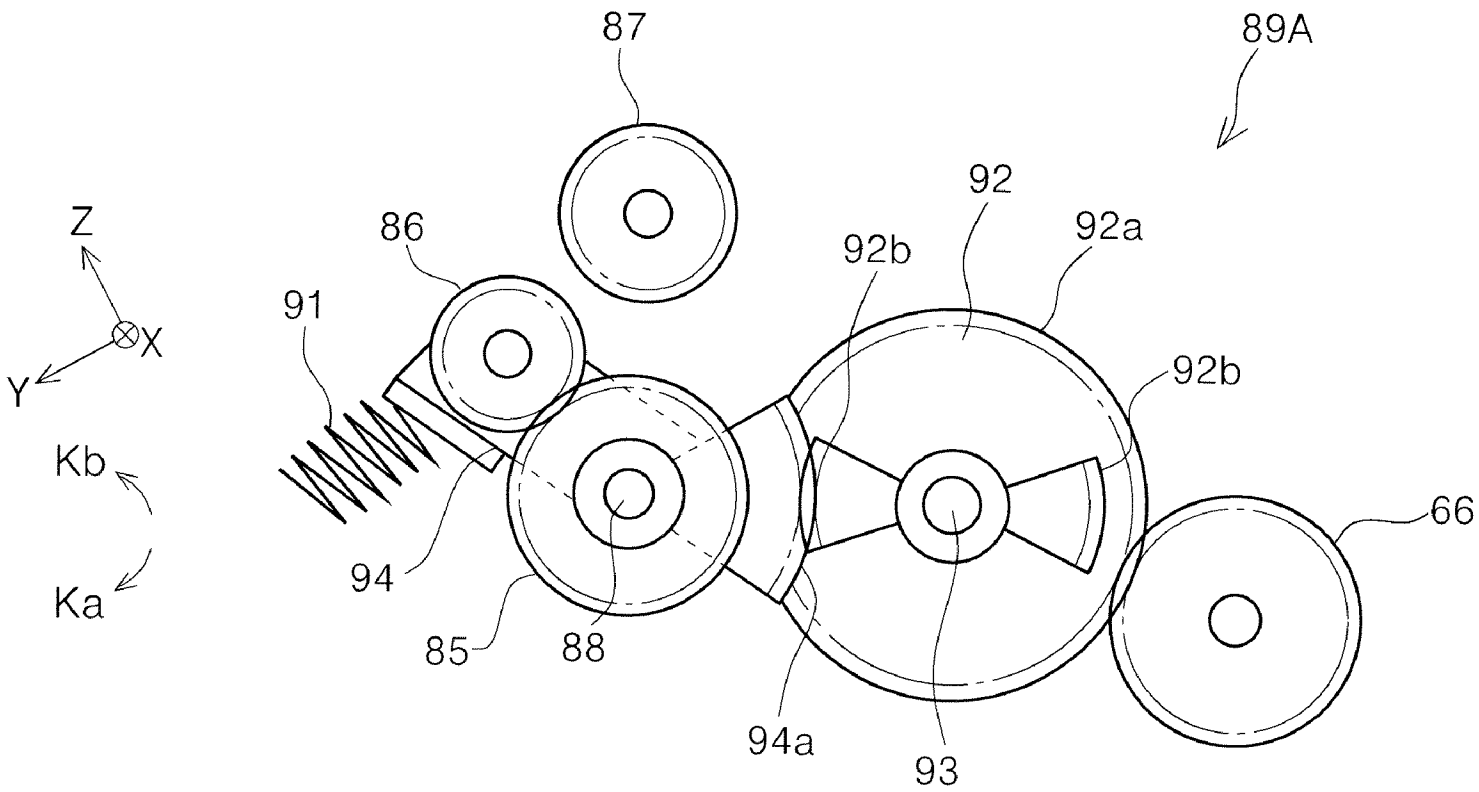
FIG. 10 is a front view of the switching section according to another embodiment when the separation roller is in the non-separating state.
Figure 11:
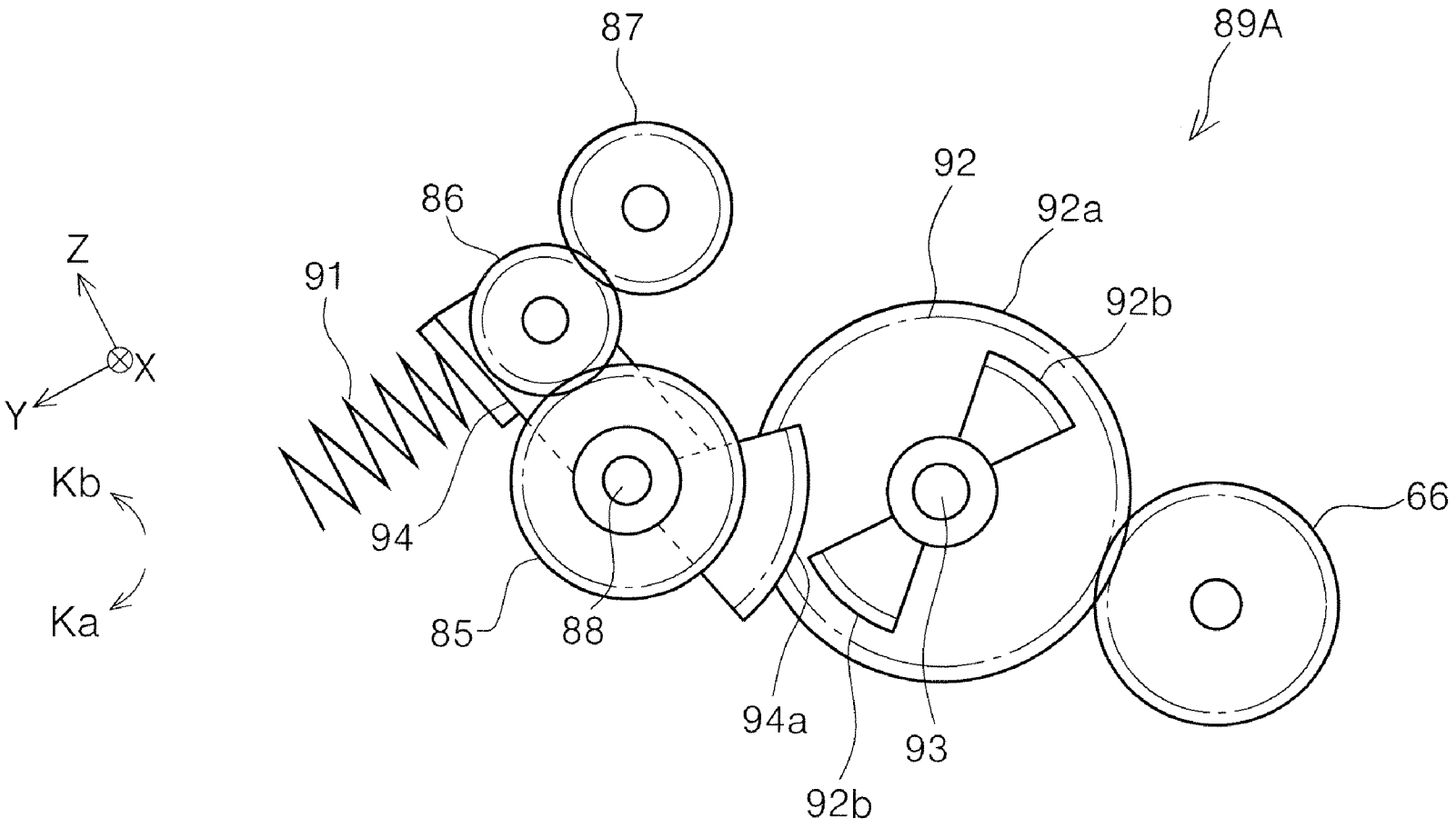
FIG. 11 is a front view of the switching section according to another embodiment when the separation roller is in the separating state.

The switching section 89 is not limited to the above described embodiment, and may take various forms. FIG. 10 and FIG. 11 show an example thereof. In FIG. 10 and FIG. 11, the same components as those described above are denoted by the same reference symbols, and the description thereof will be omitted below.

A switching section 89A includes an input gear 92 that meshes with the gear 66. The input gear 92 rotates around a rotation shaft 93. The input gear 92 is a two stage gear, a large-diameter gear 92*a* meshing with the gear 66. In a small-diameter gear 92*b*, the range in the circumferential direction where a gear is formed is limited to only a part and, as an example, the input gear 92 includes two small-diameter gears 92*b*.

The gear 86 is supported by a first swing member 94. The first swing member 94 swings around the rotation shaft 88. The first swing member 94 has a gear section 94*a*, and the gear section 94*a* can mesh with the small-diameter gear 92*b* of the input gear 92.

FIG. 10 shows a state of the switching section 89A in the case where the gear 86 is separated from the gear 87 and the separation roller 15 is in the non-separating state. In this state, the gear section 94*a* meshes with the small-diameter gear 92*b* of the input gear 92, the rotation of the first swing member 94 in the direction Ka is restricted, and the state in which the gear 86 is separated from the gear 87 is maintained.

When the input gear 92 rotates in the direction Ka from this state, the gear section 94*a* separates from the small-diameter gear 92*b* of the input gear 92, the first swing member 94 rotates in the direction Ka due to the spring force of the compression spring 91, the gear 86 meshes with the gear 87 as shown in FIG. 11, and the separation roller 15 is switched to the separating state.

When the input gear 92 rotates in the direction Ka again from this state, the gear section 94*a* meshes with the next small-diameter gear 92*b*, the first swing member 94 rotates in the direction Kb against the biasing force of the compression spring 91, the gear 86 separates from the gear 87, and the separation roller 15 is switched to the non-separating state.

Also in the present embodiment, a phase detection unit (not shown) corresponding to the above-described phase detection section 36 (see FIG. 3) is provided, and the control section 100 (see FIG. 3) can detect the phase of the input gear 92 based on the detection information of the phase detection unit, thereby detecting whether the separation roller 15 is in the separating state or the non-separating state.

In each of the above described embodiments, the control section 100 that controls the feed motor 105 controls the feed motor 105 to switch the separation roller 15 to the non-separating state if the separation roller 15 is in the separating state when feed of the document P is to be performed in the non-separating state, and controls the feed motor 105 to switch the separation roller 15 to the separating state if the separation roller 15 is in the non-separating state when feed of the document P is to be performed in the separating state.

Figure 12:
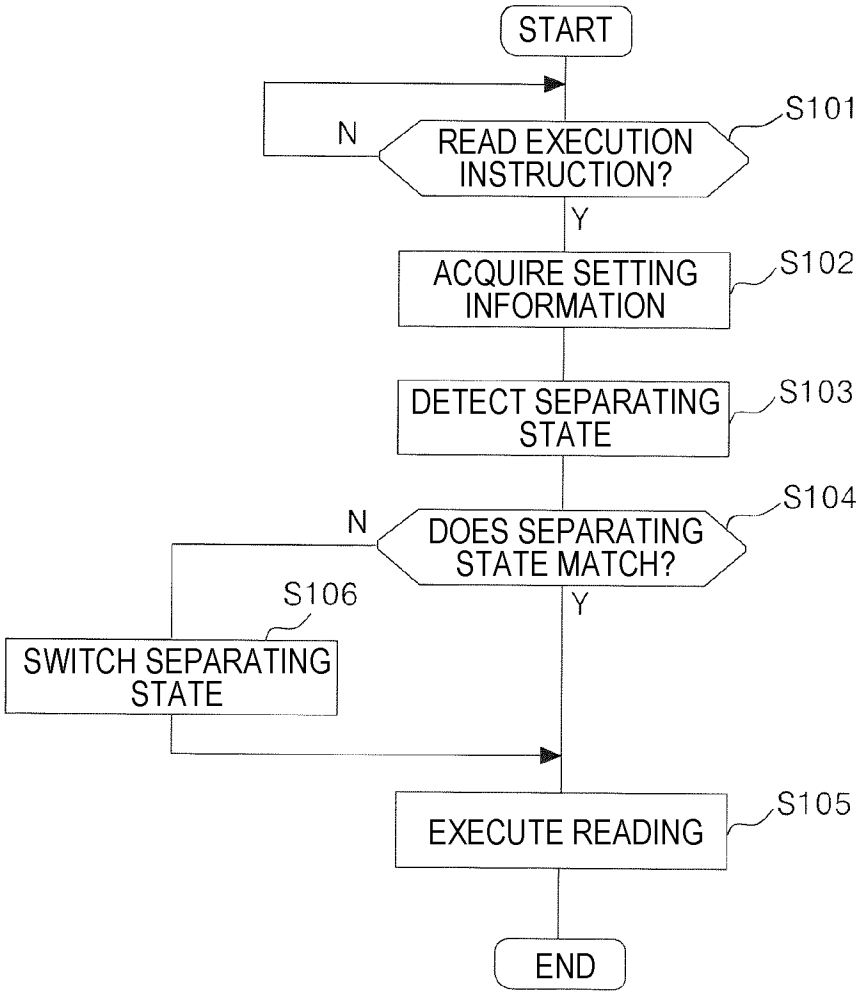
FIG. 12 is a flowchart showing a flow of processing performed by a control section.

Further description will be given below with reference to FIG. 12. When receiving an instruction to execute reading via the operation panel 7 or from the external computer 110 (Yes in step S101), the control section 100 acquires setting information (step S102). Here, the setting information is information relating to contents set on the operation panel 7 or on a scanner driver operating on the external computer 110, and is information including a reading resolution, a document size, and a document type. The document type includes at least a sheet (normal document) and a booklet. When the sheet (normal document) is set as the document type, the separation roller 15 is set to the separating state, and when the booklet is set, the separation roller 15 is set to the non-separating state.

Next, the control section 100 detects whether the separation roller 15 is in the separating state or the non-separating state (step S103) based on the information of the phase detection section 36 (see FIG. 3). Then, it is judged whether or not the current state of the separation roller 15 matches with the state suitable for the acquired document type (step S104), and if the current state of the separation roller 15 matches with the state suitable for the obtained document type (Yes in step S104), reading is executed (step S105). If the state of the separation roller 15 does not match with the state suitable for the acquired document type (No in step S104), the separating state is switched (step S106), and then reading is executed (step S105).

In this manner, when the separation roller 15 is in the separating state when feeding of the document P is to be performed in the non-separating state, the control section 100 controls the feed motor 105 to switch the separation roller 15 to the non-separating state, and when the separation roller 15 is in the non-separating state when feeding of the document P is to be performed in the separating state, the control section 100 controls the feed motor 105 to switch the separation roller 15 to the separating state, so that the document P can be appropriately fed and usability can be improved.

The present disclosure is not limited to the embodiments described above, and various modifications are possible within the scope of the disclosure described in the claims, and it goes without saying that such modifications are also included within the scope of the present disclosure.

In particular, in the above embodiment, the scanner 1 is one aspect of a medium transport device, and the medium transport device may be a recording section for recording on the medium, for example, the medium transport device for transport the medium in the recording device provided with an inkjet head.

What is claimed is:

1. An image reading device comprising:

a feed roller for feeding a medium downstream in a transport direction;

a separation roller configured to nip the medium between itself and the feed roller and to separate the medium, to enter a separating state in which the separation roller is driven in a rotation direction to return the medium upstream in the transport direction, and to enter a non-separating state in which driving force of rotation is not transmitted;

a reading section that is positioned downstream of the feed roller and the separation roller in the transport direction and that is configured to read the medium;

a switching section that includes an input gear which rotates by receiving power and that is configured to perform switching between the separating state and the non-separating state by rotation of the input gear in a certain rotation direction;

a first power transmission section configured to transmit the driving force to the input gear; and a second power transmission section that is a power transmission section configured to transmit the driving force to the separation roller and in which a switch is performed, by the switching section, between a state in which the driving force is transmitted to the separation roller and a state in which the driving force is not transmitted to the separation roller, wherein the first power transmission section is configured to transmit driving force from a first drive source that drives the feed roller to the input gear, furthermore, the first power transmission section includes a one-way clutch that does not transmit power of the first drive source to the input gear when the first drive source rotates in a first rotation direction, which is a rotation direction during medium feeding, and transmits the power of the first drive source to the input gear when the first drive source rotates in a second rotation direction, which is opposite to the first rotation direction, the second power transmission section includes a first gear and a second gear that is configured to advance and retract with respect to the first gear, that transmits the driving force to the separation roller by meshing with the first gear, and that does not transmit the driving force to the separation roller by separating from the first gear, the switching section includes a first swing member that is configured to support and swing the second gear and that causes the second gear to advance and retract with respect to the first gear by swinging, wherein the first swing member is configured to swing by rotating in accordance with the rotation of the input gear.

2. The image reading device according to claim 1, wherein the switching section further includes a pressing member configured to press the first swing member in a direction in which the second gear meshes with the first gear, a cam configured to rotate by rotation of the input gear, and a second swing member configured to swing the first swing member by rotating in accordance with rotation of the cam.

3. The image reading device according to claim 2, further comprising:

a first unit constituting one side of a transport path for transport the medium and a second unit that is configured to open and close with respect to the first unit and that constitutes the other side of the transport path in a closed state, wherein the feed roller is provided in the first unit, the separation roller is provided in the second unit, the first gear is provided in the second unit, and the second gear is provided in the first unit.

4. The image reading device according to claim 3, further comprising:

a transport roller pair that is positioned between the feeding roller and the reading section in the transport direction and that is configured to transport the medium toward the reading section, wherein the second power transmission section is configured to transmit driving force from a second drive source that drives the transport roller pair to the separation roller.

5. The image reading device according to claim 3, wherein the second power transmission section is configured to transmit the driving force from a second drive source to the separation roller.

6. The image reading device according to claim 1, further comprising a control member for controlling the first drive source, wherein when the separation roller is in the separating state when feeding of the medium is to be performed in the non-separating state, the control member controls the first drive source to switch the separation roller to the non-separating state, and when the separation roller is in the non-separating state when feeding of the medium is to be performed in the separating state, the control member controls the first drive source to switch the separation roller to the separating state.

* * * * *